United States Patent [19]

Randle

[11] 4,177,704

[45] Dec. 11, 1979

[54] PORTABLE SAW MILL

[76] Inventor: Rae Randle, Breynat, Canada, T0A 0P0

[21] Appl. No.: 855,348

[22] Filed: Nov. 28, 1977

[30] Foreign Application Priority Data

Nov. 26, 1976 [CA] Canada ..... 266697

[51] Int. Cl.[2] ..... B27B 7/04

[52] U.S. Cl. ..... 83/435.1; 83/437; 83/409

[58] Field of Search ..... 83/435.1, 707, 708, 83/409, 425, 404.4, 425.2; 144/437, 312

[56] References Cited

U.S. PATENT DOCUMENTS

| | | | |
|---|---|---|---|
| 2,803,272 | 8/1957 | Crosby | 83/404.4 |
| 3,747,455 | 7/1973 | Hartzell et al. | 83/435.1 |
| 3,875,841 | 4/1975 | Noble et al. | 83/435.1 |
| 3,960,041 | 6/1976 | Warren et al. | 83/435.1 |

*Primary Examiner*—Donald R. Schran

*Attorney, Agent, or Firm*—Richard J. Hicks; Stanley E. Johnson

[57] ABSTRACT

A relatively light, portable saw mill arrangement provided with a pair of axially mounted saw blades. A specially designed narrow log carriage runs on a track placed beneath the axial plane of the saw blades, and passes entirely between the axially mounted saw blades so that, after the final pass lumber of the order of 4"×4" is all that remains on the carriage. A hydraulic dogging arrangement holds the log in place on the carriage during the sawing operation.

9 Claims, 3 Drawing Figures

PORTABLE SAW MILL

This invention relates to saw mill equipment and in particular to a carriage for a portable saw mill which is particularly suitable for the production of small dimension lumber.

Saw mills are, of course, well known in the art and many variations thereon have been developed over the years. The earlier saw mills were generally equipped with a single saw blade but the trend in recent years has been to twin blades which permit two simultaneous cuts to be made thereby increasing productivity and, because the two blades limit distortion of the lumber, improving the accuracy of the sawn product. With a twin bladed saw mill, however, there is the problem of passing the carriage between the two blades, particularly when the blades are set in closely spaced relationship. Generally this problem has been solved by suspending the log from a carriage and dogging means above the plane of the saw as in Canadian Pat. No. 499,634 or Canadian Pat. No. 949,432 or by accepting a limitation upon the minimum size of log which can be handled as in Canadian Pat. No. 840,733. In either solution the construction necessary is relatively massive, the equipment is expensive to construct and difficult to maintain and operate. Also, when the carriage is above the plane of the saw blades it is difficult for the sawyer to position himself to view the cutting operations which, in turn, tends to lead to inaccurate products and reduction in productivity. There is, therefore, a need for, and it is an object of the present invention to provide, a relatively light, easily portable, saw mill which can be moved to a small job site and operated by relatively unskilled labour without departing from the standards of accuracy demanded from the massive equipment of the prior art and at production rates equal to or surpassing those obtained from known saw mills.

It has been found that this need can be satisfied by combining the saw mill base and the carriage track and designing a simple narrow trough-like carriage to run on the track in a plane below the axis of rotation of the saw blades. By thus placing the carriage below the saw blades the sawyer has an uninterrupted view of the sawing operation in progress.

Thus by one aspect of this invention there is provided a saw mill for cutting small dimension lumber comprising;

(a) a rigid frame;

(b) a horizontal rail mounted longitudinally on said rigid frame;

(c) a pair of arbors mounted on said rigid frame for rotation about parallel axes in a plane above and normal to said horizontal rail;

(d) a pair of circular saw blades each axially mounted for rotation on a respective one of said pair of arbors;

(e) means for adjusting said saw blades to selected positions spaced on opposite sides of said horizontal rail;

(f) driving means for rotating said arbors and saw blades;

(g) a carriage engaging said rail for movement therealong and dimensioned to pass between said saw blades at any said selected position; and (h) means for reciprocating said carriage to carry a log thereon past said saw blades.

The invention will be described in more detail hereinafter with reference to the accompanying drawings in which.

Figure 1:
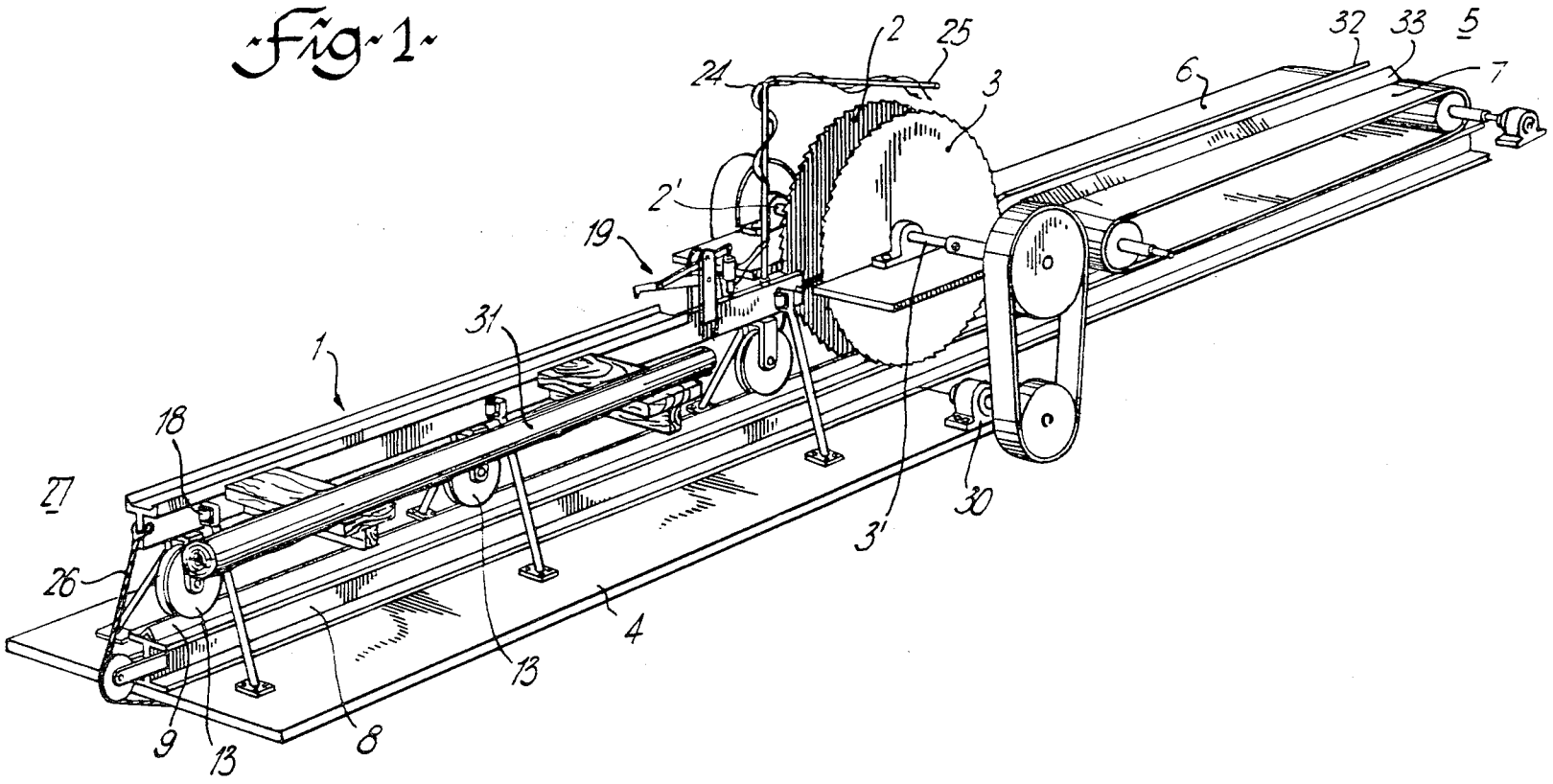
FIG. 1 is a perspective view of a saw mill arrangement according to the present invention without a log therein.

In FIG. 1 there is shown a saw mill 1 generally according to the invention. A pair of circular saw blades 2, 3 are mounted in transversely movable and side by side axial relationship on arbors 2' and 3' which are secured to a base 4 as in a conventional saw mill. The saw blades are adjustable on their axis to be more or less closely spaced and to permit milling of lumber from 5 to 30" in diameter. At their closest spacing there is preferably about 4" between the blades. The blades are driven by any conventional saw drive motor 30. On the delivery side 5 of the mill there are provided a pair of endless belts 6 and 7 to facilitate removal of the sawn lumber on each side of the longitudinal centre line of the mill. As with blades 2 and 3, the belts 6 and 7 are transversely adjustable to accomodate different sizes of lumber.

Longitudinally and centrally of the entire length of the mill 1 there is provided a channel member 8, preferably about 4" wide, which is mounted securely on the base 4. A guide member 9, preferably triangular, is welded along the length of the upper surface 10 of the channel member 8 and together they form a guide rail 11, as shown more clearly in FIG. 2.

Figures 2, 3:
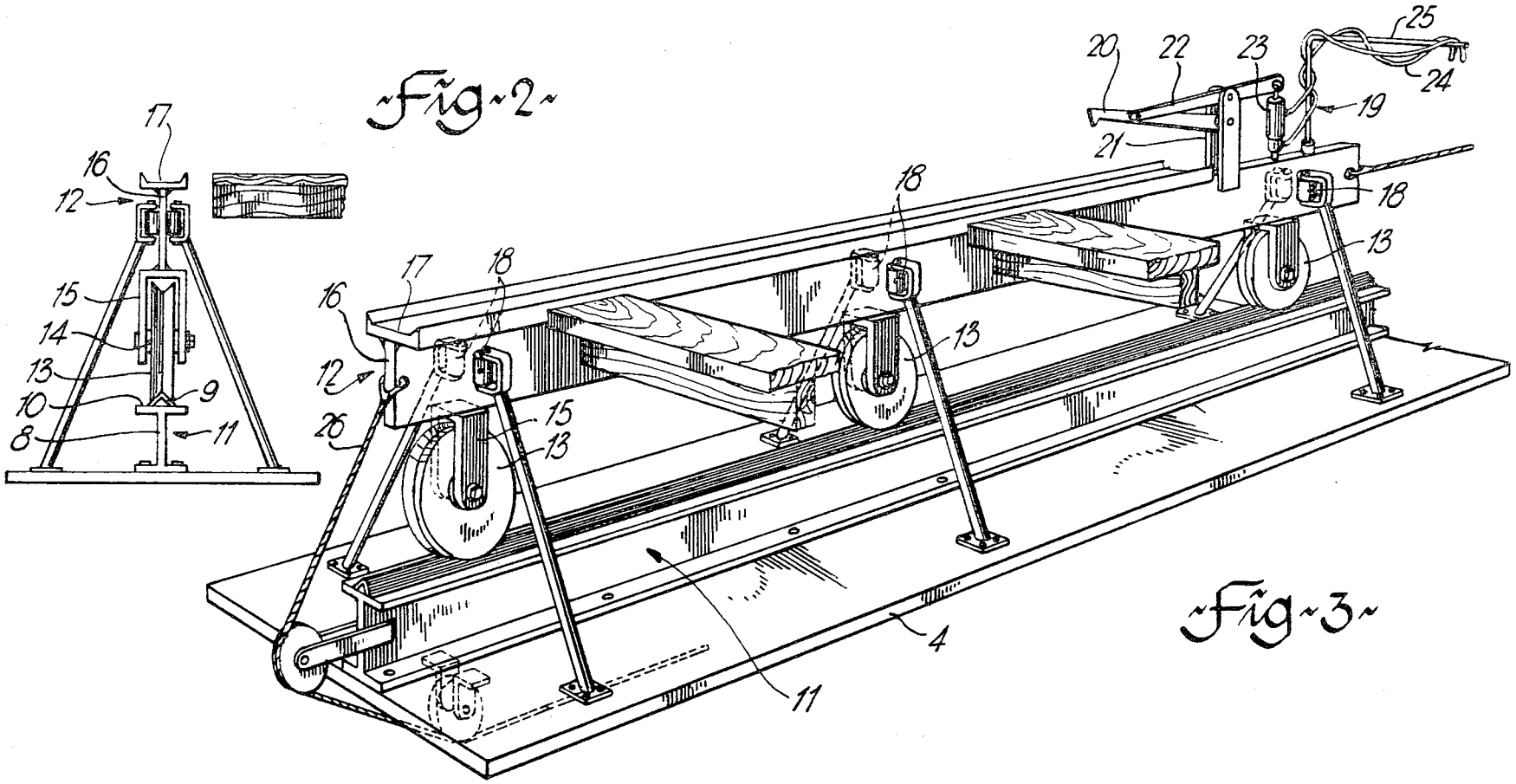
FIG. 2 is an end view of the carriage of the saw mill of the present invention.
FIG. 3 is a close-up view of the dogging arrangement and the carriage of the saw mill of the present invention.

A carriage 12, shown more clearly in FIG. 3, is mounted for longitudinal movement along the guide rail 11, by means of a series of grooved wheels 13 which engage guide member 9 and run on surface 10. The wheels 13 are each mounted on bearings 14 in housings 15 and spaced along the length of beam 16, which is preferably fabricated in steel and about 16 feet long. Normal to the beam 16 there is provided a C-shaped member 17, which is preferably about 14 feet long and welded longitudinally along beam 16 as shown more clearly in FIG. 3, so as to form a trough to receive a log to be sawn 31. A plurality of roller carriage guides 18 are provided at spaced intervals along the length and on both sides of the mill 1 so as to guide and retain the carriage 12 on the rail 11.

In order to hold a log in the carriage 12 a dogging arrangement 19 is provided adjacent one or both ends of the carriage. For simplicity only a single dogging arrangement is shown in FIGS. 1 and 3 but it will be appreciated that a second dogging arrangement may be provided at the other longitudinal end of the carriage 12. The dogging arrangement 19 is preferably of the hydraulic type and generally comprises a dogging arm 20 adapted to engage and hold a log, pivotally mounted on a post 21. A second arm 22 is also pivotally mounted on post 21 and operatively connected to arm 20 and to hydraulic cylinder means 23 which is in turn connected to a control means (not shown) via hydraulic lines 24. The hydraulic control means may conveniently be mounted on the sawyers platform on one side of the mill, generally adjacent the saw blades 2,3. A boom 25 is generally provided to carry the hydraulic lines 24 clear of the saw blades 2,3 and it will be appreciated that lines 24 must be of sufficient length to enable the carriage 12 to travel the entire length of the rail 11 in either longitudinal direction. Carriage 12 is drawn back and forth along the track 11 by means of a chain or cable 26 and any convenient and conventional drive mechanism (not shown) through a conventional friction drive or clutch mechanism (not shown).

In operation, a log 31 is rolled into the trough 17 from the entry side 27 of mill 1, and held therein by means of the dogging arm 20 which is actuated by hydraulic cylinder 23. The saw blades 2 and 3 are laterally adjusted to give the desired clearance therebetween and to cut the desired thickness from each side of the log. The saw blades are then rotated in known manner and the carriage 12 advanced along the track 13. As soon as the end of the log passes the blades 2,3 the sawn pieces of lumber fall onto adjacent conveyors 6,7 for disposal. It will be appreciated that angled guides 32,33 may be provided to facilitate this action.

The motion of the carriage 12 is then reversed to return the carriage to the input side 27. The blades 2,3 are adjusted for the next successive cut and the process is repeated. After the last pass the piece of lumber remaining on the trough 17 is generally only 4"×4" or 4"×6" and is removed for use as dimension lumber, posts or the like.

It will be appreciated that because the entire carriage is designed to pass between the saw blades, even when set at their minimum distance apart, the waste lumber produced is negligible and usefully sized lumber can be produced on a single mill at high production rates. Because the carriage is carried almost entirely on the main frame or base of the mill and there is no requirement for overhead supports, the weight of the entire mill is considerably reduced and the construction simplified to an extent such that it is economically feasible to move the mill from job site to job site. The carriage itself is relatively light and therefore requires little power to move it along the track.

I claim:

1. A portable saw mill for cutting logs into small dimension lumber, comprising, in combination:

(a) a rigid frame providing a lower base;

(b) a longitudinally extending rigid rail mounted on said base;

(c) a carriage reciprocally mounted on said rail, said carriage having an upper surface for supporting a log to be cut;

(d) a pair of arbors mounted on said base for rotation about parallel axes normal to said horizontal rail and each having a circular saw blade mounted thereon for cutting a log carried by the movable carriage;

(e) means for moving said saw blades towards and away from each other to vary the spacing therebetween, and having a selected minimum spacing slightly larger than the width of the movable carriage, whereby the carriage can pass between the saw blades during cutting of a log carried thereby;

(f) log hold down means mounted on said carriage clampingly to press the log onto the log supporting upper surface thereof and dimensioned to pass between said saw blades during reciprocal movement of the carriage; and (g) guide means for guiding the carriage during reciprocal movement thereof along the rail, said guide means engaging the carriage at a position below the log supporting surface thereof; said combination providing a lightweight, rigid portable saw mill having no supporting structure located in a plane above the movable carriage so as to permit unobstructed viewing of a log during cutting.

2. A saw mill as claimed in claim 1 wherein said log hold down means includes hydraulic means to secure said log to said carriage.

3. A saw mill as claimed in claim 2 including conveyor means on the output side of said saw mill to facilitate discharge of said small dimension lumber.

4. A saw mill as claimed in claim 1 wherein said carriage includes a plurality of wheels for engaging said rail.

5. A saw mill as claimed in claim 4 wherein said carriage includes a plurality of grooved wheels for engaging complimentary means on said rail.

6. A saw mill as claimed in claim 1 wherein said guide means include a plurality of roller carriage guides on opposite sides of said carriage.

7. A saw mill as claimed in claim 1, wherein said saw blades are transversely adjustable to a minimum spacing of about four inches.

8. A saw mill as claimed in claim 1, wherein said carriage includes trough means to receive a log.

9. A saw mill as claimed in claim 1, wherein said arbors are mounted for rotation about a common axis.

* * * * *